US008022924B2

(12) United States Patent
Weng et al.

(10) Patent No.: US 8,022,924 B2
(45) Date of Patent: Sep. 20, 2011

(54) FIELD SEQUENTIAL LIQUID CRYSTAL DISPLAY AND DRIVING METHOD THEREOF

(75) Inventors: Ruey-Shing Weng, Kaohsiung (TW); Shin-Tai Lo, Miaoli (TW); Fa-Chen Wu, Taichung (TW)

(73) Assignee: Wintek Corporation, Taichung (TW)

( * ) Notice: Subject to any disclaimer, the term of this patent is extended or adjusted under 35 U.S.C. 154(b) by 908 days.

(21) Appl. No.: 11/987,585

(22) Filed: Dec. 3, 2007

(65) Prior Publication Data

US 2008/0158207 A1 Jul. 3, 2008

(30) Foreign Application Priority Data

Dec. 29, 2006 (TW) ..... 95150045 A

(51) Int. Cl.
*G09G 3/36* (2006.01)

(52) U.S. Cl. ..... 345/102; 345/88

(58) Field of Classification Search ..... 345/88, 345/102, 207; 349/61
See application file for complete search history.

(56) References Cited

U.S. PATENT DOCUMENTS

| | | | | |
|---|---|---|---|---|
| 6,930,737 | B2 * | 8/2005 | Weindorf et al. | 349/96 |
| 7,199,780 | B2 * | 4/2007 | Sekine | 345/102 |
| 2006/0188745 | A1 * | 8/2006 | Liao et al. | 428/690 |
| 2006/0221044 | A1 * | 10/2006 | Negley et al. | 345/102 |
| 2006/0279671 | A1 * | 12/2006 | Han et al. | 349/61 |

* cited by examiner

*Primary Examiner* — Quan-Zhen Wang
*Assistant Examiner* — Calvin Ma
(74) *Attorney, Agent, or Firm* — Bacon & Thomas, PLLC

(57) ABSTRACT

A field sequential driving method includes the following steps. First, a liquid crystal display (LCD) including a display unit and a backlight unit is provided. The display unit includes several pixel units. Next, a white light source of the backlight unit is enabled during a first sub-frame period of a frame period of the LCD. Then, red and blue sub-pixel data are provided to drive a first sub-pixel and a second sub-pixel in the pixel unit during the first sub-frame period. Next, a green light source of the backlight unit is enabled during a second sub-frame period of the frame period. Thereafter, green sub-pixel data is provided to drive a third sub-pixel of the pixel unit during the second sub-frame period.

10 Claims, 6 Drawing Sheets

FIELD SEQUENTIAL LIQUID CRYSTAL DISPLAY AND DRIVING METHOD THEREOF

This application claims the benefit of Taiwan application Serial No. 95150045, filed Dec. 29, 2006, the subject matter of which is incorporated herein by reference.

BACKGROUND OF THE INVENTION

1. Field of the Invention

The invention relates in general to a liquid crystal display (LCD), and more particularly to a field sequential LCD.

2. Description of the Related Art

A white light source, such as a white light emitting diode (LED) or a cold cathode fluorescent lamp (CCFL), often serves as a backlight source in conventional liquid crystal displays. In addition, the conventional LCD further displays a color image composed of red, green and blue colors using the white backlight source in conjunction with a pixel structure including red, green and blue sub-pixels. However, the conventional LCD has several drawbacks.

FIG. 1 (Prior Art) is a chromaticity diagram showing a CIE model of a conventional LCD, wherein C1 and C2 respectively define a gamut of a NTSC (National Television System Committee) television system standard and a gamut of the conventional LCD. Because the green saturation, which may be displayed by the conventional LCD using a white light source in conjunction with a green color filter, is lower, the conventional LCD has the drawback of the insufficient green saturation.

In addition, the green saturation of the conventional LCD is insufficient, so the gamut that may be displayed by the LCD is substantially smaller than that of the NTSC television system standard. Thus, the conventional LCD further has the drawback of the narrower gamut.

SUMMARY OF THE INVENTION

The invention is directed to a field sequential liquid crystal display (LCD) and a field sequential driving method, which can effectively improve the insufficient green saturation and the narrower display gamut of the conventional LCD.

According to a first aspect of the present invention, a field sequential LCD including a control unit, a backlight unit and a display unit is provided. The control unit receives pixel data, which comprises red sub-pixel data, green sub-pixel data, blue sub-pixel data and black sub-pixel data. The control unit outputs the red and blue sub-pixel data during a first sub-frame period of a frame period and outputs the green sub-pixel data during a second sub-frame period of the frame period. The backlight unit includes a white light source and a green light source, which are driven by the control unit to output white light and green light during the first and second sub-frame periods, respectively. The white and green light sources are disabled during the second and first sub-frame periods. The display unit includes a plurality of pixel units each including first, second and third sub-pixels. The first sub-pixel includes a red color filter and displays a red data frame according to the red sub-pixel data and the white light during the first sub-frame period. The second sub-pixel includes a blue color filter and displays a blue data frame according to the blue sub-pixel data and the white light during the first sub-frame period. The third sub-pixel includes a green color filter and displays a green data frame according to the green sub-pixel data and the green light during the second sub-frame period. The control unit provides the black sub-pixel data to the first and second sub-pixels during the second sub-frame period, and provides the black sub-pixel data to the third sub-pixel during the first sub-frame period.

According to a second aspect of the present invention, another field sequential LCD including a control unit, a backlight unit and a display unit is provided. The control unit receives pixel data, which comprises red sub-pixel data, green sub-pixel data, blue sub-pixel data and black sub-pixel data, outputs the red and blue sub-pixel data during a first sub-frame period of a frame period, and outputs the green sub-pixel data during a second sub-frame period of the frame period. The backlight unit includes a white light source and a green light source, which are driven by the control unit to output white light and green light during the first and second sub-frame periods, respectively. The white and green light sources are disabled during the second and first sub-frame periods. The display unit includes a plurality of pixel units each including first, second and third sub-pixels. The first sub-pixel includes a red color filter and displays a red data frame according to the red sub-pixel data and the white light during the first sub-frame period. The second sub-pixel includes a blue color filter and displays a blue data frame according to the blue sub-pixel data and the white light during the first sub-frame period. The third sub-pixel displays a green data frame according to the green sub-pixel data and the green light during the second sub-frame period. The control unit provides the black sub-pixel data to the first and second sub-pixels during the second sub-frame period.

According to a third aspect of the present invention, a field sequential driving method is provided. The method includes the following steps. First, a liquid crystal display (LCD) is provided. The LCD includes a backlight unit and a display unit. The display unit includes several pixel units. Next, a white light source of the backlight unit is enabled to output white light during a first sub-frame period of a frame period of the LCD. Then, red sub-pixel data is provided to drive a first sub-pixel of the pixel unit during the first sub-frame period, and the first sub-pixel displays a red data frame according to the red sub-pixel data and the white light. Next, blue sub-pixel data is provided to drive a second sub-pixel of the pixel unit during the first sub-frame period, and the second sub-pixel displays a blue data frame according to the blue sub-pixel data and the white light. Then, a green light source of the backlight unit is enabled to output green light during a second sub-frame period of the frame period. Next, green sub-pixel data is provided to drive a third sub-pixel of the pixel unit during the second sub-frame period, and the third sub-pixel displays a green data frame according to the green sub-pixel data and the green light.

The invention will become apparent from the following detailed description of the preferred but non-limiting embodiments. The following description is made with reference to the accompanying drawings.

DETAILED DESCRIPTION OF THE INVENTION

First Embodiment

Figure 1:
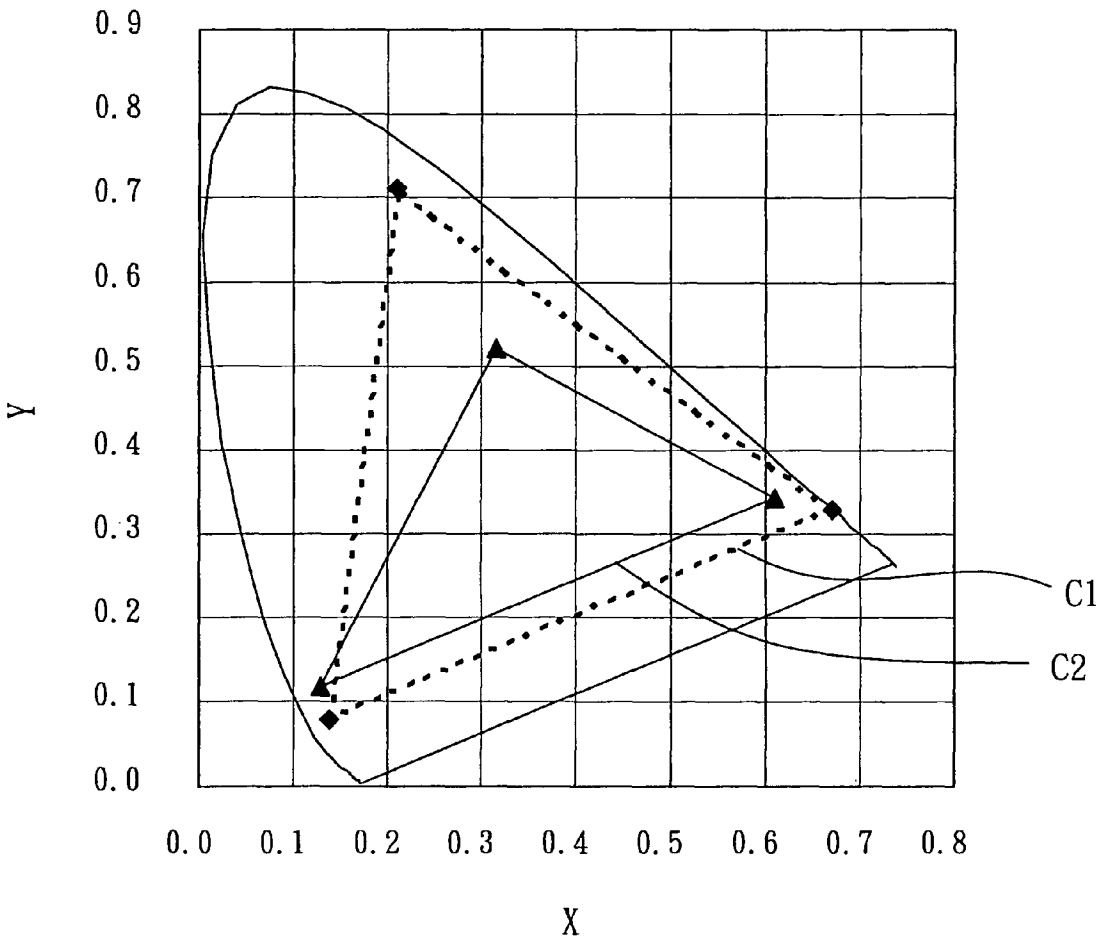
FIG. 1(PRIOR ART)
FIG. 1 (Prior Art) is a chromaticity diagram showing a CIE model of a conventional LCD.
Figure 2:
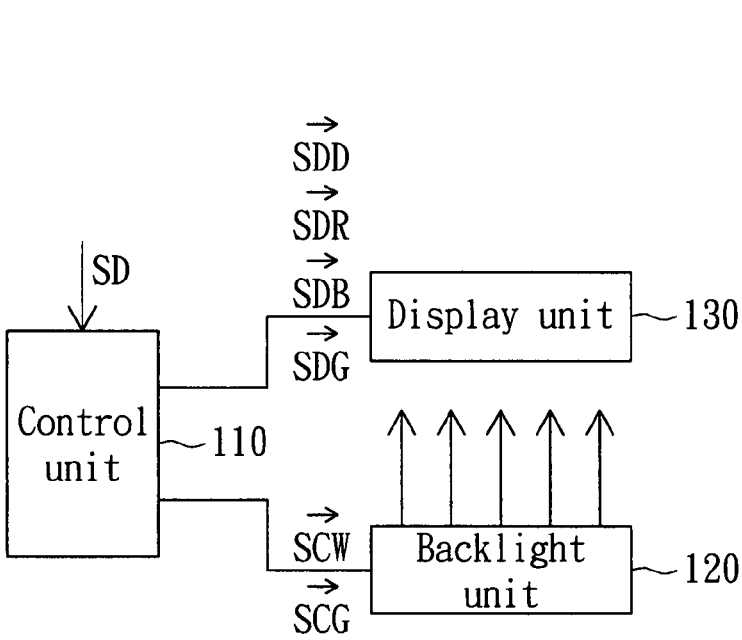
FIG. 2 is a block diagram showing a field sequential LCD according to a first embodiment of the invention.
Figure 3:
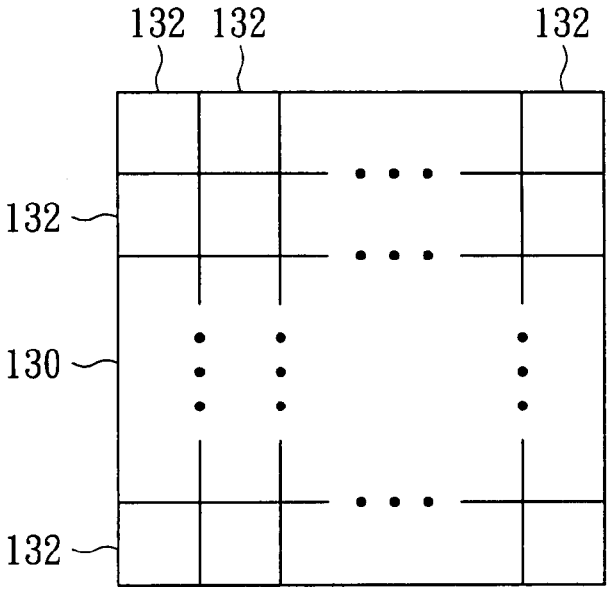
FIG. 3 is a structural top view showing a display unit 130 of FIG. 2.
Figure 4:
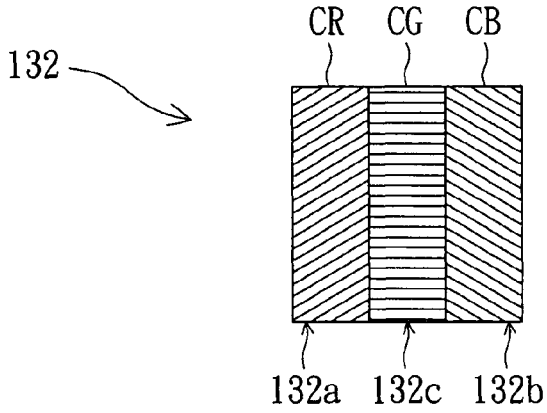
FIG. 4 is a top view showing a detailed structure of a pixel unit 132 of FIG. 3.
Figure 5:
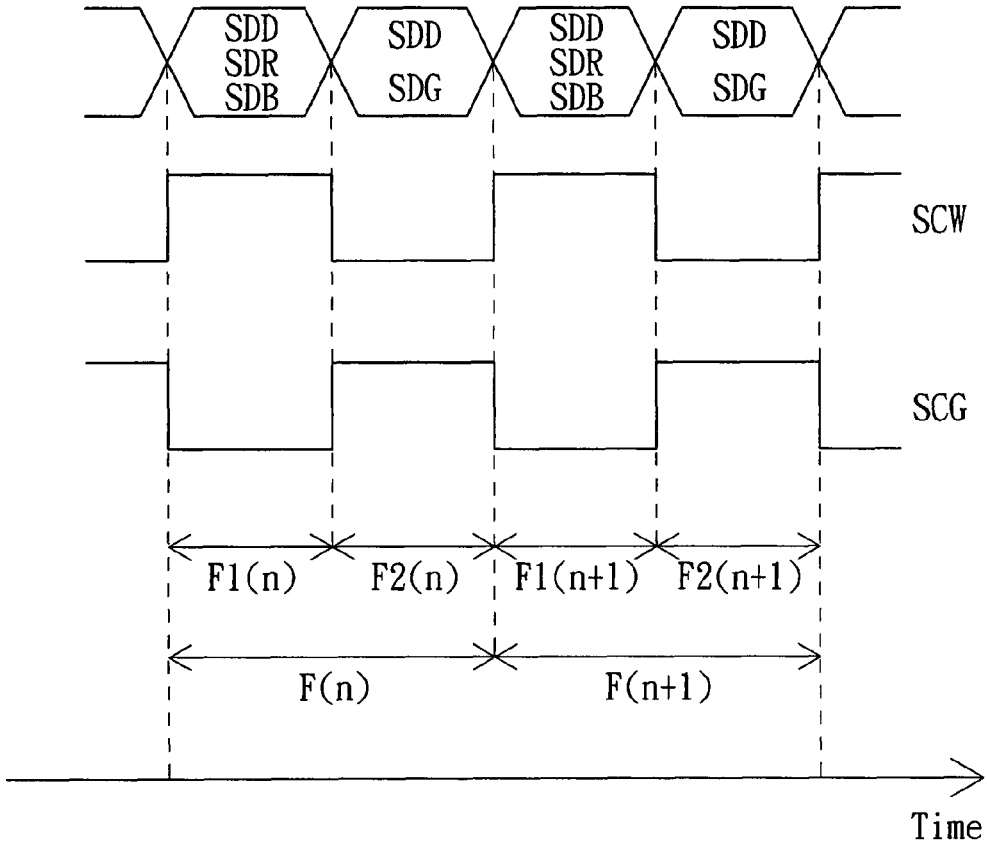
FIG. 5 is a timing chart showing signals associated with the field sequential LCD 200 of FIG. 2.

FIG. 2 is a block diagram showing a field sequential LCD according to a first embodiment of the invention. FIG. 3 is a structural top view showing a display unit 130 of FIG. 2. FIG. 4 is a top view showing a detailed structure of a pixel unit 132 of FIG. 3. FIG. 5 is a timing chart showing signals associated with a field sequential LCD 200 of FIG. 2. Referring to FIGS. 2 to 5, the field sequential LCD 200 includes a control unit 110, a backlight unit 120 and the display unit 130. The backlight unit 120 is electrically connected to the display unit 130 and the control unit 110.

The control unit 110 receives pixel data SD, which includes red sub-pixel data SDR, green sub-pixel data SDG, blue sub-pixel data SDB and black sub-pixel data SDD. The control unit 110 outputs red, blue and black sub-pixel data SDR, SDB and SDD during a first sub-frame period F1(n) of a frame period F(n) of the field sequential LCD 200, and outputs the green and black sub-pixel data SDG and SDD during a second sub-frame period F2(n) of the frame period F(n), wherein n is a natural number. The control unit 110 further outputs driving signals SCW and SCG to drive the backlight unit 120 to emit light. The enabled time periods of the driving signals SCW and SCG are staggered, and are respectively equal to the first and second sub-frame periods F1(n) and F2(n). The frame period F(n) of this embodiment may be 16.67 ms, and the cycle times of the first and second sub-frame periods F1(n) and F2(n) are equal to each other, and equal to one half of the cycle time of the frame period F(n), that is, 8.33 ms.

The backlight unit 120 includes a white light source (not shown) and a green light source (not shown). In this embodiment, the white and green light sources are respectively white and green light emitting diode (LED) arrays (not shown). The white and green diode arrays are respectively driven by the driving signals SCW and SCG to output white light (not shown) and green light (not shown) during the first and second sub-frame periods F1(n) and F2(n), respectively. The white and green diode arrays are respectively disabled during the second and first sub-frame periods F2(n) and F1(n).

The display unit 130 includes a plurality of pixel units 132 each including sub-pixels 132*a*, 132*b* and 132*c*. The sub-pixel 132*a* includes a red color filter CR, and the sub-pixel 132*b* includes a blue color filter CB. During the first sub-frame period F1(n) of each frame period F(n), the white light outputted from the backlight unit 120 passes through the sub-pixels 132*a* and 132*b* to display a red data frame and a blue data frame, respectively. The sub-pixel 132*c* includes a green color filter CG. During the second sub-frame period F2(n) of each frame period F(n), the green light outputted from the backlight unit 120 passes through the sub-pixel 132*c* to display a green data frame. Consequently, the field sequential LCD 200 may display the red, green and blue data frames during the frame period F(n). Because the human eyes have the persistence of vision, the user can watch the full-color frame displayed.

The control unit 110 of this embodiment further outputs the black sub-pixel data SDD to the sub-pixels 132*a* and 132*b* during the second sub-frame period, and outputs the black sub-pixel data SDD to the sub-pixel 132*c* during the first sub-frame period so as to prevent the white light and the green light outputted from the backlight unit 120 from passing through the sub-pixels 132*a* to 132*c* incorrectly and thus displaying the incorrect data frames.

Figure 6:
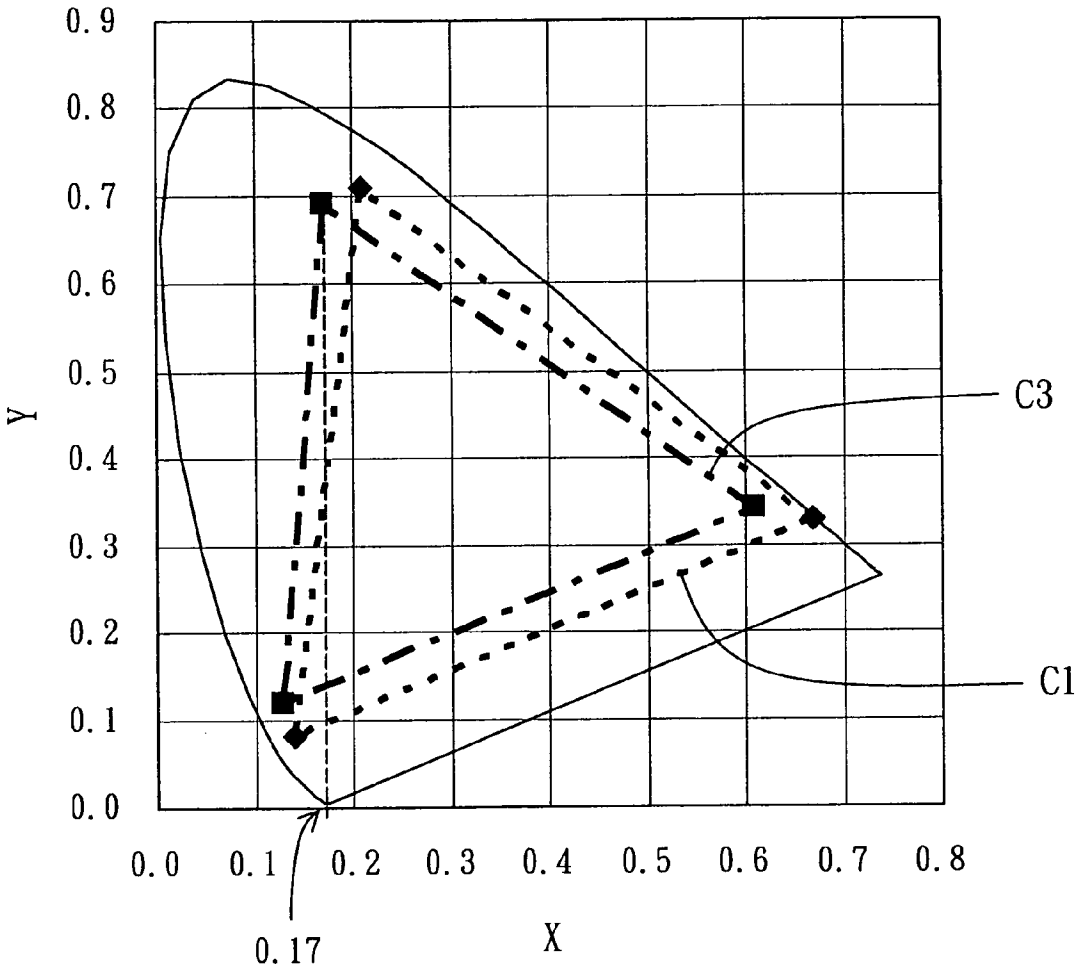
FIG. 6 is a chromaticity diagram showing a CIE model of the field sequential LCD 200 according to the first embodiment of the invention.

FIG. 6 is a chromaticity diagram showing a CIE model of the field sequential LCD 200 according to the first embodiment of the invention. Referring to FIG. 6, the curve C3 defines a displaying gamut of the field sequential LCD 200 of this embodiment. The field sequential LCD 200 of this embodiment displays the green data frame using the green light outputted from the green LED array in conjunction with the green color filter CG. Compared with the conventional LCD, the green light displayed using the white light outputted from the white LED in conjunction with the green color filter CG has the better color saturation, and the green CIE coordinates thereof are (0.17,0.7), for example.

Thus, the green light displayed by the field sequential LCD 200 of this embodiment and the green light with the NTSC specification have the saturation values substantially approaching each other. Consequently, the LCD 200 of this embodiment may effectively improve the drawback of the insufficient green saturation that may be displayed by the conventional LCD, substantially has the better color saturation of the green light that may be displayed, and advantageously makes the green component of the displayed frame of the LCD 200 more garish.

In addition, the displaying gamut of the field sequential LCD 200 of this embodiment may also be enhanced with the enhancement of the color saturation of the green light that may be displayed so that the displaying gamut of the field sequential LCD 200 of this embodiment substantially approaches the gamut specified by the NTSC. Consequently, the field sequential LCD 200 of this embodiment further has the advantage of the wider displaying gamut.

Figure 7:
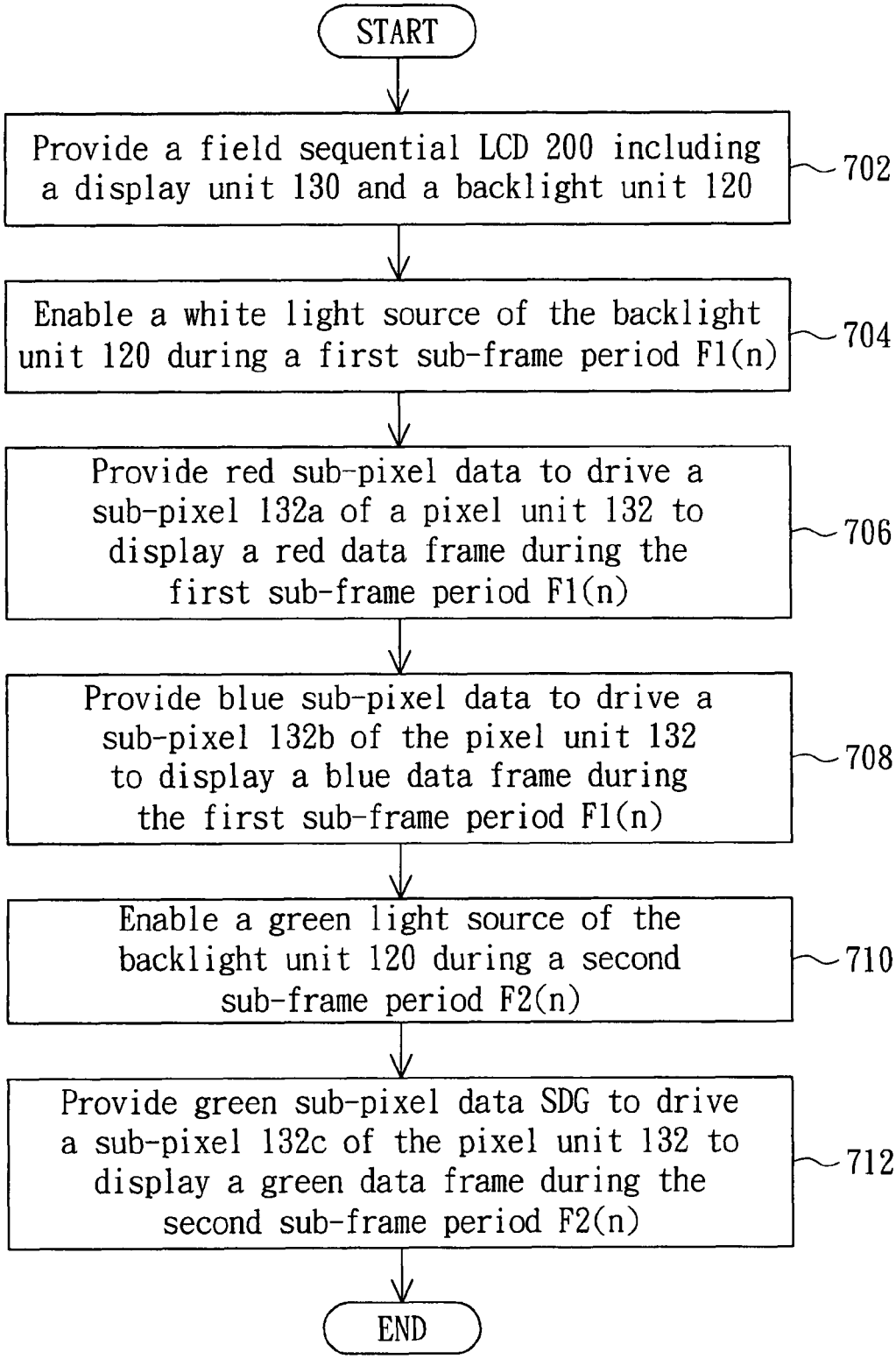
FIG. 7 is a flow chart showing a field sequential driving method according to the first embodiment of the invention.

FIG. 7 is a flow chart showing a field sequential driving method according to the first embodiment of the invention. First, as shown in step 702, the field sequential LCD 200 including the display unit 130 and the backlight unit 120 is provided. The display unit 130 includes multiple pixel units 132. Next, as shown in step 704, a white LED array of the backlight unit 120 is enabled to output the white light during the first sub-frame period F1(n) of the frame period F(n). Then, as shown in step 706, the red sub-pixel data SDR is provided to drive the sub-pixel 132*a* of the pixel unit 132. The sub-pixel 132*a* displays the red data frame according to the red sub-pixel data SDR and the white light. Next, in step 708, the blue sub-pixel data SDB is provided to drive the sub-pixel 132*b* of the pixel unit 132 during the first sub-frame period F1(n) of the frame period F(n). The sub-pixel 132*b* displays the blue data frame according to the blue sub-pixel data SDB and the white light.

Then, in step 710, the green LED array of the backlight unit 120 is enabled to output the green light during the second sub-frame period F2(n) of the frame period F(n). Thereafter, as shown in step 712, the green sub-pixel data SDG is provided to drive the sub-pixel 132*c* of the pixel unit 132 during the second sub-frame period F2(n). The sub-pixel 132*c* displays the green data frame according to the green sub-pixel data SDG and the green light.

The steps 704 to 708 of the field sequential driving method of this embodiment further include providing the black sub-pixel data SDD to drive the sub-pixel 132*c* of the pixel unit 132 during the first sub-frame period F1(n) so that the sub-pixel 132*c* displays the black frame to prevent the white light from passing through the sub-pixel 132*c* to generate the green light and thus influence the effects of displaying the blue and red data frames. The steps 710 and 712 of the field sequential driving method of the embodiment further include providing the black sub-pixel data SDD to drive the sub-pixels 132*a* and 132*b* of the pixel unit 132 during the second sub-frame period F2(n) to prevent the green light from passing through the sub-pixels 132*a* and 132*b* to generate the red and blue light to influence the effect of displaying the green data frame.

The field sequential LCD of this invention has the backlight unit including the white light source and the green light source, and the pixel structure including the red, blue and green sub-pixels. The white and green light sources are enabled during the first and second sub-frame periods of the frame period of the LCD. The red and blue sub-pixels respectively receive the red and blue sub-pixel data during the first sub-frame period to display the red and blue field sequential frames, and the green sub-pixel receives the green sub-pixel data to display the green field sequential frame during the second sub-frame period. Consequently, the field sequential LCD of this embodiment may enhance the color saturation of the green light using the green light outputted from the green light source in conjunction with the green sub-pixel. Consequently, the field sequential LCD of this embodiment can effectively improve the insufficient green saturation and the insufficient frame gamut that may be displayed by the conventional LCD, and thus has the higher green saturation and the wider frame gamut that may be displayed.

Second Embodiment

Figure 8:
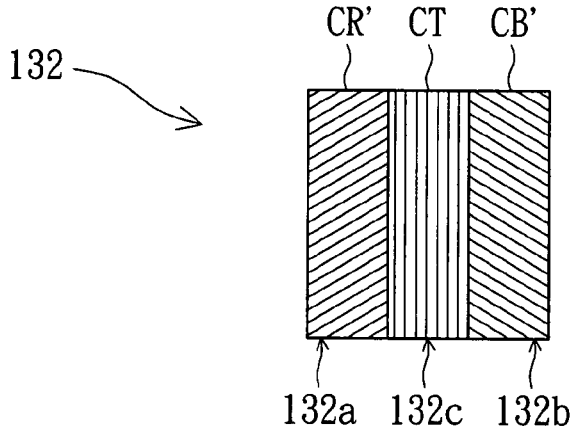
FIG. 8 is a top view showing another detailed structure of the pixel unit 132 of FIG. 3 according to a second embodiment of the invention.

FIG. 8 is a top view showing another detailed structure of the pixel unit 132 of FIG. 3 according to a second embodiment of the invention. The field sequential LCD of this embodiment is different from the field sequential LCD 200 of the first embodiment in that the field sequential LCD of this embodiment replaces the green color filter CG with the white filter CT of the pixel unit 132. That is, the field sequential LCD 200 of this embodiment displays the green frame using the white filter CT in conjunction with the green light outputted from the green LED array.

The color saturation of the green light that may be displayed using the white filter CT in conjunction with the green light outputted from the green LED array substantially approaches the green light saturation that may be displayed by the field sequential LCD of the first embodiment. Thus, the field sequential LCD of this embodiment may also effectively improve the drawbacks of the insufficient green saturation and the insufficient frame gamut that may be displayed by the conventional LCD, and thus has the advantages of the higher green saturation and the wider frame gamut.

In this embodiment, the condition in which the white filter CT replaces the green color filter CG is illustrated. However, the same effect may also be achieved at the position of the white filter CT without using any filter.

Third Embodiment

Figure 9:
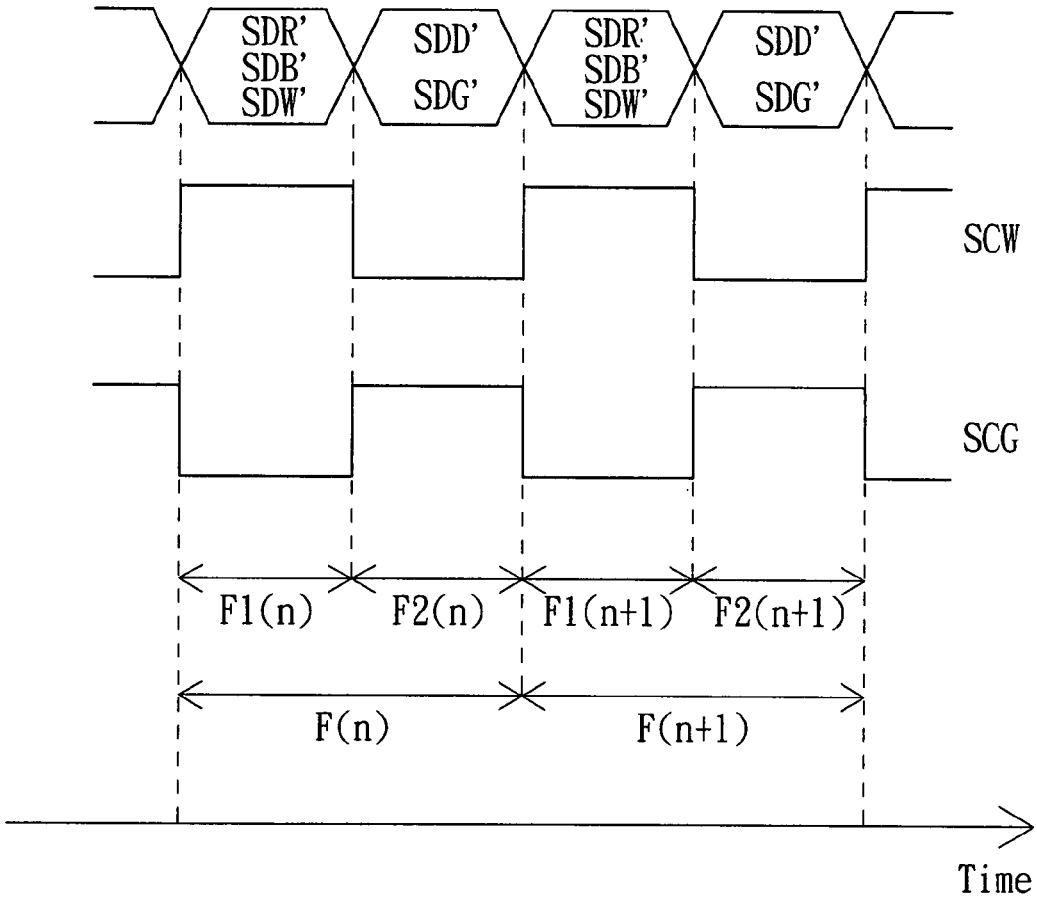
FIG. 9 is a timing chart showing signals associated with the field sequential LCD 200 of FIG. 5 according to a third embodiment of the invention.

FIG. 9 is a timing chart showing signals associated with the field sequential LCD 200 of FIG. 5 according to a third embodiment of the invention. The field sequential LCD of this embodiment differs from the field sequential LCD of the second embodiment in that the control unit 110 converts the red, green and blue sub-pixel data SDR, SDG and SDB into red compensated sub-pixel data SDR', green compensated sub-pixel data SDG', blue compensated sub-pixel data SDB' and white compensated sub-pixel data SDW' according to the image data processing method disclosed in U.S. Pat. Nos. 5,929,843, 6,724,934 or 6,536,904.

The control unit 110 of this embodiment further differs from the control unit of the first embodiment in that the red, blue and white compensated sub-pixel data SDR', SDB' and SDW' are respectively outputted to the sub-pixels 132*a*, 132*b* and 132*c* of the pixel unit 132 during the first sub-frame period F1(n) so that the red, blue and white data frames may be displayed, but the red, green and black sub-pixel data SDR, SDB and SDD are not outputted to drive the sub-pixels 132*a*, 132*b* and 132*c*, respectively.

The control unit 110 of this embodiment outputs the green compensated sub-pixel data SDG' to the sub-pixel 132*c* of the pixel unit 132 during the second sub-frame period F2(n) to display the green data frame, and further outputs the black sub-pixel data SDD' to the sub-pixels 132*a* and 132*b* of the pixel unit 132 during the second sub-frame period F2(n) so that the black data frame may be displayed.

The difference between the field sequential driving method of this embodiment and those of the first and second embodiments is that the field sequential driving method of this embodiment does not provide the black sub-pixel data SDD to the sub-pixel 132*c* in the steps 704 to 708, but provides the white compensated sub-pixel data SDW' to the sub-pixel 132*c* of the pixel unit 132 to display the white data frame.

The field sequential LCD of this embodiment displays the color frames including the red, green, blue and white data frames using the backlight unit including the white and green light sources in conjunction with the pixel structure including the red, white and blue sub-pixels. The field sequential LCD of this embodiment may also enhance the color saturation of the green light through the green light outputted from the green light source in conjunction with the white sub-pixel. Consequently, the field sequential LCD of this embodiment may also effectively improve the drawbacks of the insufficient green saturation and the insufficient frame gamut that may be displayed by the conventional LCD, and thus has the advantages of the higher green saturation and the wider frame gamut that can be displayed.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A field sequential liquid crystal display (LCD), comprising:

a control unit for receiving pixel data, which comprises red sub-pixel data, green sub-pixel data, blue sub-pixel data and black sub-pixel data, wherein the control unit outputs the red and blue sub-pixel data during a first sub-frame period of a frame period and outputs the green sub-pixel data during a second sub-frame period of the frame period;

a backlight unit comprising a white light emitting diode (LED) and a green LED, which are driven by the control unit to output white light and green light during the first and second sub-frame periods, respectively, wherein the white and green LEDs are disabled during the second and first sub-frame periods, respectively; and a display unit comprising a plurality of pixel units, each of which comprises:

a first sub-pixel, which comprises a red color filter and displays a red data frame according to the red sub-pixel data and the white light during the first sub-frame period;

a second sub-pixel, which comprises a blue color filter and displays a blue data frame according to the blue sub-pixel data and the white light during the first sub-frame period; and a third sub-pixel, which comprises a green color filter and displays a green data frame according to the green sub-pixel data and the green light during the second sub-frame period;

wherein the control unit provides the black sub-pixel data to the first and second sub-pixels during the second sub-frame period, and provides the black sub-pixel data to the third sub-pixel during the first sub-frame period;

during the first sub-frame period, the control unit concurrently outputs the red, the blue and the black sub-pixel data to the first, the second and the third sub-pixels, respectively; and during the second sub-frame period, the control unit concurrently outputs the black, the black and the green sub-pixel data to the first, the second and the third sub-pixels, respectively.

2. A field sequential liquid crystal display (LCD), comprising:

a control unit for receiving pixel data, which comprises red sub-pixel data, green sub-pixel data, blue sub-pixel data and black sub-pixel data, outputting the red and blue sub-pixel data during a first sub-frame period of a frame period, and outputting the green sub-pixel data during a second sub-frame period of the frame period;

a backlight unit comprising a white LED and a green LED, which are driven by the control unit to output white light and green light during the first and second sub-frame periods, respectively, wherein the white and green LEDs are disabled during the second and first sub-frame periods, respectively; and a display unit comprising a plurality of pixel units, each of which comprises:

a first sub-pixel, which comprises a red color filter and displays a red data frame according to the red sub-pixel data and the white light during the first sub-frame period;

a second sub-pixel, which comprises a blue color filter and displays a blue data frame according to the blue sub-pixel data and the white light during the first sub-frame period; and a third sub-pixel for displaying a green data frame according to the green sub-pixel data and the green light during the second sub-frame period;

wherein the control unit provides the black sub-pixel data to the first and second sub-pixels during the second sub-frame period, during the first sub-frame period, the control unit concurrently outputs the red, the blue, and the black sub-pixel data to the first, the second and the third sub-pixels, respectively; and during the second sub-frame period, the control unit concurrently outputs the black, the black and the green sub-pixel data to the first, the second and the third sub-pixels, respectively.

3. The LCD according to claim 2, wherein the control unit provides the black sub-pixel data to the third sub-pixel during the first sub-frame period.

4. The LCD according to claim 2, wherein the pixel data further comprises white sub-pixel data, and the control unit outputs the white sub-pixel data to the third sub-pixel during the first sub-frame period.

5. The LCD according to claim 4, wherein the third sub-pixel further receives the white sub-pixel data during the first sub-frame period and outputs a white data frame according to the white sub-pixel data and the white light.

6. The LCD according to claim 2, wherein the third sub-pixel comprises a white filter.

7. A field sequential driving method applicable to a liquid crystal display (LCD) having a display unit and a backlight unit, the display unit having a plurality of pixel units, the method comprising the steps of:

enabling a white LED of the backlight unit to output white light during a first sub-frame period of a frame period;

providing red sub-pixel data to drive a first sub-pixel of the pixel units during the first sub-frame period, the first sub-pixel displaying a red data frame according to the red sub-pixel data and the white light;

providing blue sub-pixel data to drive a second sub-pixel of the pixel units during the first sub-frame period, the second sub-pixel displaying a blue data frame according to the blue sub-pixel data and the white light;

enabling a green LED of the backlight unit to output green light during a second sub-frame period of the frame period; and providing green sub-pixel data to drive a third sub-pixel of the pixel units during the second sub-frame period, the third sub-pixel displaying a green data frame according to the green sub-pixel data and the green light;

wherein:

during the first sub-frame period, the control unit concurrently outputs the red, the blue, and the white sub-pixel data to the first, the second and the third sub-pixels, respectively; and during the second sub-frame period, the control unit concurrently outputs the black, the black and the green sub-pixel data to the first, the second and the third sub-pixels, respectively.

8. The method according to claim 7, further comprising the step of:

providing black sub-pixel data to drive the first and second sub-pixels during the second sub-frame period.

9. The method according to claim 7, further comprising the step of:

providing the black sub-pixel data to drive the third sub-pixel during the first sub-frame period.

10. The method according to claim 7, further comprising the step of:

providing white sub-pixel data to drive the third sub-pixel during the first sub-frame period, the third sub-pixel outputting a white data frame according to the white sub-pixel data and the white light.

* * * * *